United States Patent [19]

LeRoy

[11] 4,409,033

[45] Oct. 11, 1983

[54] SIMULATED MOVING BED SEPARATION PROCESS FOR HIGH VISCOSITY FEED STREAMS

[75] Inventor: Charles F. LeRoy, San Antonio, Tex.

[73] Assignee: UOP Inc., Des Plaines, Ill.

[21] Appl. No.: 332,401

[22] Filed: Dec. 18, 1981

[51] Int. Cl.[3] ..... C13D 3/14

[52] U.S. Cl. ..... 127/46.2; 127/46.3; 208/310 R; 210/277; 210/278; 55/77; 55/79; 55/81

[58] Field of Search ..... 127/46.2, 46.3; 208/310; 210/277, 278; 55/77, 79, 81

[56] References Cited

U.S. PATENT DOCUMENTS

| | | | |
|---|---|---|---|
| 2,985,589 | 5/1961 | Broughton et al. | 210/34 |
| 3,231,492 | 1/1966 | Stine et al. | 208/310 R |
| 3,291,726 | 12/1966 | Broughton | 208/310 |
| 4,182,633 | 1/1980 | Ishikawa et al. | 127/46 A |
| 4,226,639 | 10/1980 | Michalko et al. | 127/46 A |
| 4,226,977 | 10/1980 | Neuzil et al. | 536/1 |
| 4,319,929 | 3/1982 | Fickel | 127/46.2 |

*Primary Examiner*—Ferris H. Lander

*Attorney, Agent, or Firm*—James R. Hoatson, Jr.; John F. Spears, Jr.; William H. Page, II

[57] ABSTRACT

An improvement is achieved in the operation of a process for the adsorptive separation of different components of a viscous high density feed stream, such as the separation of fructose from an aqueous mixture containing 50 wt. % fructose and glucose, in which the use of a moving bed of adsorbent is simulated. The improvement results from locating the fluid distribution means which switches the flow of the process streams between conduits leading to various points in the adsorbent bed at an elevation which is above the adsorbent bed. This reduces contamination of the next process stream to flow through the conduits which previously carried the feed stream.

13 Claims, 1 Drawing Figure

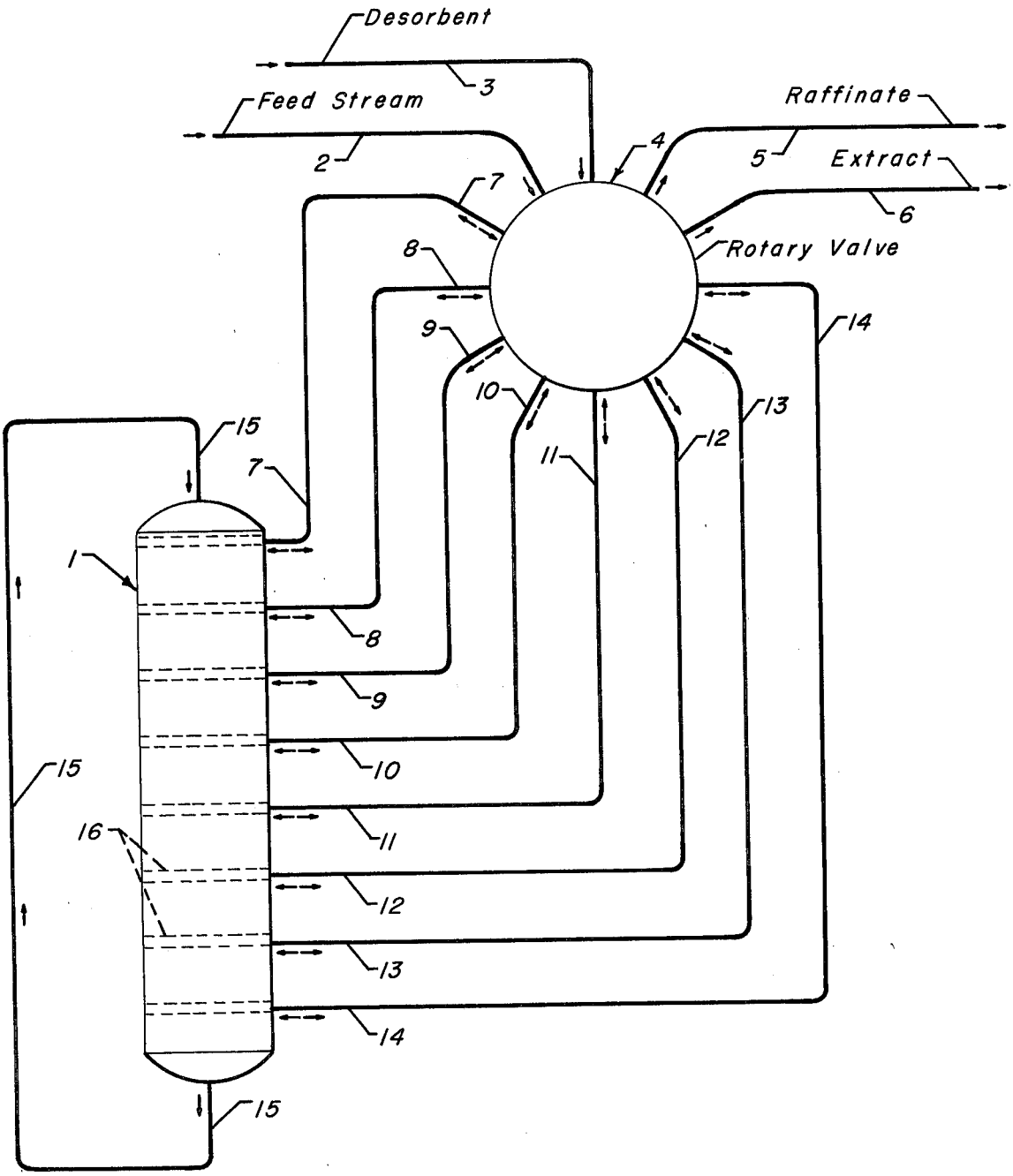
Desorbent
3
Feed Stream
2
Raffinate
5
Extract
6
4
7
8
Rotary Valve
9
14
10
13
15
12
11
7
1
8
9
10
15
11
16
12
13
14
15

SIMULATED MOVING BED SEPARATION PROCESS FOR HIGH VISCOSITY FEED STREAMS

FIELD OF THE INVENTION

The invention relates to a continuous process for the separation of two chemical compounds present in a high density high viscosity feed stream through the use of adsorption techniques. The invention is more specifically related to an adsorptive separation process in which a flow distribution device is employed to simulate the utilization of a moving bed of adsorbent. The invention specifically relates to the height of the flow distribution device in relation to the vertical bed of solid adsorbent used in this process. A specific application of the invention is in the separation of fructose or glucose from a concentrated high viscosity mixture of fructose and glucose.

PRIOR ART

The separation of various chemical compounds through selective adsorption is a well developed process which is widely used commercially in the chemical and petrochemical industries. It is described in basic reference sources. The simulation of a moving bed of adsorbent in a separation process is also well known and is used commercially. This technique is described in U.S. Pat. Nos. 2,985,589 and 3,291,726 issued to D. B. Broughton and in U.S. Pat. No. 4,182,633 issued to H. Ishikawa et al.

The use of adsorptive techniques including the use of a simulated moving bed of adsorbent for the separation of various monosaccharides from a mixture of saccharides, such as the separation of fructose from a mixture of fructose and glucose is well described in U.S. Pat. No. 4,226,639 issued to E. Michalko et al and in U.S. Pat. No. 4,226,977 and R. W. Neuzil et al.

It is believed that heretofore the rotary valve or other fluid distribution device used in simulated moving bed adsorptive separation processes has been located at an elevation which is approximately midway between the ends of the bed of adsorbent. This assumes a vertical column of adsorbent. If two or more columns are employed, they are the same elevation and the fluid distribution device is still located midway between the top and the bottom of the columns. This location was chosen to minimize the length, and hence the volume, of the longest conduit required to connect the fluid distribution device with the many different inlet-outlet points along the length of the adsorbent bed. It was believed that by minimizing this maximum length the most efficient flushing of feed material from the lines would be activated and that the degree of backmixing in the most troublesome conduits would be minimized. This practice originated in a process for the separation of totally miscible hydrocarbons such as the separation of paraxylene from a mixture of other xylene isomers.

BRIEF SUMMARY OF THE INVENTION

The invention reduces in-line backmixing of high viscosity streams with other streams which subsequently flow through a process line which has just been used to transport the high viscosity stream. This improvement is achieved by the better flushing of the viscous, high density liquid from the process line. The better flushing results from all, rather than just some, of the process lines which carry the feed stream to the adsorbent bed descending from the flow distribution device to the adsorbent bed. This is in contrast to the prior art arrangement in which one-half of these process lines ran upward from the flow distribution means to the adsorbent bed.

One broad embodiment of the invention may be characterized as a process for the adsorptive separation of chemical compounds which comprises the steps of passing a multi-component feed stream which comprises at least 35 wt.% solids on a dry basis through a rotary valve type flow distribution means and into a fixed vertical bed of a solid adsorbent which selectively adsorbs at least one component of the feed stream at a first point in the bed of adsorbent; passing a desorbent stream through the flow distribution means and into the bed of adsorbent at a second point; withdrawing a raffinate stream which has a reduced relative concentration of the selectively adsorbed component from the bed of adsorbent at a third point; withdrawing an extract stream which has a relatively increased concentration of the selectively adsorbed component from the bed of adsorbent at a fourth point; and periodically advancing the locations of the first, second, third and fourth points in the bed of adsorbent in a unidirectional pattern, with the first, second, third and fourth points at all times being at an elevation which is below that of the fluid distribution means. The invention is based on the discovery that the best overall flushing of the process lines is not obtained by minimizing the average length of the lines but rather by orienting the lines such that the feed and flush streams flow downward through all instead of some of the process lines.

BRIEF DESCRIPTION OF THE DRAWING

The Drawing is a simplified diagram showing a vertical bed of adsorbent 1 and a rotary valve 4 which is utilized as a fluid distribution means of an adsorptive separation process in which the movement of the adsorbent bed is simulated. This Drawing has been simplified by showing only eight fluid transfer conduits labeled 7–14 extending from points at different elevations along the height of the adsorbent bed to the rotary valve. In a commercial application between 8 and 30 such lines or conduits would normally be employed. A high viscosity feed stream such as a high solids content mixture of fructose and glucose enters the process through line 2 and passes through the rotary valve emerging through line 8. The feed stream then enters the bed of adsorbent 1 and passes downward through two layers of adsorbent before the remainder of the feed stream emerges from the adsorbent bed as a raffinate stream carried by line 10. The rotary valve conducts the raffinate stream from line 10 to line 5 and this stream is then withdrawn from the process.

A desorbent stream, which may be water, enters the process through line 3 and is transferred by the rotary valve to line 12. The desorbent stream then enters the bed of adsorbent and flows downward through two segments of the bed of adsorbent and is then removed as an extract stream carried by line 14. The extract stream enters the rotary valve and is transferred to line 6 for removal from the process. A flush stream is often also used in the process and would be directed through the different lines 7–14 by the rotary valve. The flush stream may be supplied from an external source through a line not shown or may be withdrawn from the bed of adsorbent through these same lines.

Each stream which enters the bed of adsorbent is distributed across the cross section of the adsorbent bed by distributor means 16, which also serves as mixing means at points intermediate addition or withdrawal points. These same distributors also collect the process streams which are withdrawn from the adsorbent bed. Also required for the simulation of a moving bed of adsorbent is a stream referred to as a pump-around stream carried by line 15 which removes liquid from the bottom of the column and passes this liquid into the top of the adsorbent column as part of the simulation technique.

DETAILED DESCRIPTION

Separatory processes which simulate the use of a moving bed of a solid adsorbent are in widespread use. They are used commercially for the separation of different types of hydrocarbons when it is more difficult or expensive to separate these compounds by other means such as fractionation. Examples of the separations which are often performed using this technique include the separation of ethylbenzene from a mixture of xylenes, the separation of acyclic olefins and acyclic paraffins, and the separation of normal paraffins and isoparaffins. Typically, the selectively adsorbed materials have very similar boiling points. Another common application of adsorptive separation using moving bed techniques is the recovery of a particular class of hydrocarbon from a broad boiling point range mixture of two or more classes of hydrocarbons. An example of this is the separation of $C_{10}$-$C_{14}$ normal paraffins from a mixture which also contains $C_{10}$-$C_{14}$ isoparaffins. The use of simulated moving bed separatory processes has been described for the separation of unsaturated fatty acids from saturated fatty acids and for the separation of fructose from mixtures containing fructose and glucose.

As described in more detail below, the preferred method of simulating the use of a moving bed of adsorbent requires the passage of the feed stream into the adsorbent bed at one of a number of different points. This is accomplished by switching the flow of the feed stream into different conduits or pipes, each of which enters the preferably vertical bed of adsorbent at a different point along the height of the adsorbent bed. The feed stream enters the adsorbent bed through only one line at a time, with other lines, which may number up to 30 or more, either carrying one of the other 3–6 process streams which are normally employed or being temporarily unused. Each conduit will therefore at some time carry each of the difference process streams which is passed into or withdrawn from the adsorbent bed.

When any of these process streams first begins to flow through a conduit, it must displace the liquid which is then contained within that conduit along the distance between the device used to switch the flows of the process streams and the point at which that conduit enters the adsorbent bed. This may result in the admixture of considerable quantities of fluids. Often it is not desired to admix some of the process streams because such admixture will reduce either the total separatory capacity or separatory efficiency which is achieved within the process. For instance, if a conduit is used to transport the feed stream and some of the feed stream still remains in this conduit when it is subsequently used to remove the extract stream from adsorbent bed, then extract stream will become contaminated with the raffinate components of the feed stream. The purity of the feed stream is therefore reduced and the performance of the process is degraded.

Several methods have been employed to counteract the operational problem of back mixing between various process streams within the fluid transfer lines. It is first of all possible, although sometimes not preferable, to utilize a flush material to remove one process stream from the conduits before a subsequent process stream is passed into this conduit. An intermediate process stream may act as this flush stream. Another approach is to minimize the length and hence the volume of the conduits between the flow distribution device and the adsorbent bed. It is believed that the commercially applied approach to the minimization of this volume has been to locate the flow distribution device at a midpoint between the ends of the adsorbent column. This minimizes the length of the longest conduit necessary to reach from the flow distribution device to any point in the adsorbent bed. This in turn limits the maximum amount of any stream which may be trapped within this longest conduit and the maximum amount of contamination which is possible. This approach was deemed preferable to locating the flow distribution device at a point closer to the extremities of the adsorbent bed. Such a terminal location would minimize or greatly reduce cross-contamination in some of the process lines but at the same time it would necessarily increase the volume and cross-contamination potential in all other process lines. It would also present the potential for greater variation in the concentration of the various components in the effluent streams from the bed.

A second and perhaps more important factor in the decision to locate the flow distribution means at the midpoint of the adsorbent column was a desire to minimize the amount of flush material which is passed through the various process lines for the purpose of removing one process stream from the process line before the line is used to carry a different process stream. The reduction in the total amount of flush stream utilized results from the application of a design factor which specifies the flow volume of the flush stream as a percentage of the volume of the largest volume conduit.

The processing techniques described above have been found to be very effective in the processing of petrochemicals, which has been the predominant application to date of simulated moving bed separation technology. However, the new and growing application of the same processing techniques to the separation of viscous, high density or "high solids" streams has resulted in the discovery of an unforeseen operational problem. It has now been discovered that water, which is the preferred flush and solvent material, does not function well as a flush material for the removal of high solids feed streams from vertical process conduits when it is attempted to flush the lines in an upward direction. The water tends to bubble upward through the more viscous high solids material and the desired degree of solids removal is difficult to achieve without the utilization of excessive amounts of water. It is usually desirable to minimize the amount of flush material required to operate the process because the flush material must often be separated from the product. This is especially true when, as is preferred, the process is used to separate fructose or glucose from a mixture of fructose and glucose since it is normally required to evaporate all or most of the water which becomes admixed into the extract stream due to its use as flush or desorbent fluid.

The heat required to affect this evaporation increases the utility cost of operating the process. If the viscous high density material is not removed from the process line it will contaminate the next process fluid to pass through the line if the admixture of the fluid and the high density material can be classified as contamination.

It is therefore an objective of the subject invention to provide a simulated moving bed adsorptive separation process for high solids content feed streams. It is another objective of the invention to reduce the contamination of a subsequent stream which flows through a conduit with compounds present in a high viscosity stream which was previously passed through the conduit. It is a further objective of the subject invention to provide an improved process for the separation of monosaccharides from a feed stream containing at least 35 wt.% solids. It is a specific objective of the invention to provide a process for the separation of fructose from a mixture of fructose and glucose which contains over 40 wt.% solids.

As used herein, the term "high solids" is intended to indicate a solids content in excess of 25 wt.% which is determined by the evaporation or vaporization of the total liquid content of a process feed stream. Although a 25 wt.% solids content is considered a high solids content stream, the solids content of process feed streams may be at higher levels and may be equal to 40 to 50 wt.% solids. A solids content of 50 wt.% is not abnormally high and higher solids contents are possible. The use of the term solids in reference to various liquid streams is derived from the natural state of the pure compounds of interest at standard conditions of temperature and pressure. At these conditions pure (dry) common sugars are a solid in comparison to commonly separated hydrocarbons such as xylene which are a liquid.

High solids content feed streams are typically encountered in the processing of feed streams found in the food industries. That is, the high solids content feed streams are typically encountered in processes for the separation of materials derived from a vegetable rather than a petroleum base. The feed stream may therefore be derived from such agricultural commodities as corn, soy beans, sunflower seeds, sorgum or sugar beets. These high solids feed streams will typically employ water as a solvent although the utilization of other solvents or a mixture of solvents or a mixture of water and an organic compound as the solvent is also possible.

The subject adsorptive separation processes require the sequential performance of at least three basic steps. The adsorbent must first be brought into contact with a feed stream comprising the particular compounds to be collected while the adsorbent is maintained at adsorption-promoting conditions. This adsorption step should continue for a time sufficient to allow the adsorbent to collect a near equilibrium amount of the preferentially adsorbed compounds. The second basic step is the contacting of the adsorbent bearing both the preferentially and the non-preferentially adsorbed compounds with a material which displaces the latter from the adsorbent. This second step is performed in a manner which results in the adsorbent containing significant quantities of only the preferentially adsorbed feed component and the material used to displace the non-preferentially adsorbed compounds.

The third basic step of the adsorptive separation process is the desorption of the preferentially adsorbed compound. This may be performed by changing the conditions of temperature and pressure at which the adsorbent is maintained, but in the subject process it is performed by contacting the adsorbent with a desorbent stream. The desorbent stream contains a chemical compound capable of displacing or desorbing the preferentially adsorbed compound from the adsorbent to thereby release these compounds and prepare the adsorbent for another adsorption step. The desorbent compound and the preferentially adsorbed compounds become intermingled and are removed from the adsorbent as a stream referred to as the extract stream.

The sequential adsorption and desorption steps of an adsorptive separation process can be performed using a fixed bed of adsorbent having a fixed inlet and outlet points at opposite ends of an adsorbent bed. However, certain very significant benefits may be obtained by simulating the movement of the bed of adsorbent. These benefits include the continuous production of a high purity product stream. This has led to the commercial utilization of simulated moving bed adsorptive separation processes. Preferably, the countercurrent flow of the bed of solid adsorbent and the various entering liquid streams is simulated.

Two separate actions are involved in a moving bed simulation. The first of these is the maintenance of a net fluid flow through the bed of adsorbent in a direction opposite to the direction of simulated movement of the adsorbent. This is performed through the use of a pump operatively connected in a manner to achieve this circulation along the length of the entire bed of adsorbent. This fluid flow is larger than the other process streams of the process. The pump is normally located in a conduit which connects the two ends of the bed of adsorbent. The second action involved in simulating the movement of the adsorbent bed is the periodic actual movement of the location of the various zones, such as the adsorption zone, along the length of the bed of adsorbent. This actual movement of the location of the various zones is performed gradually in a unidirectional pattern by periodically advancing the points at which the entering streams enter the adsorbent bed and the points at which the effluent streams are withdrawn from the adsorbent bed. It is only the locations of the zone as defined by the respective feed and withdrawal points along the bed of adsorbent which are changed. The adsorbent bed itself is fixed and does not move.

A gradual and incremental movement of the adsorption zone, and the other zones, is achieved by periodically advancing the actual points of liquid addition or withdrawal to the next available potential point. That is, in each advance of the adsorption zone, the boundaries marking the beginning and the end of each zone will move by the relatively uniform distance between two adjacent potential points of liquid addition or withdrawal. The majority of the zone is unaffected and remains intact since the zone normally extends past several of these fluid transfer points.

The bed of adsorbent may be contained in one or more separate interconnected vessels. At a large number of points along the length of the bed of adsorbent, the appropriate openings and conduits are provided to allow the addition or the withdrawal of liquid. At each of these points, there is preferably provided a constriction of the cross section of the adsorbent bed by a liquid distributor-collector. These may be similar to the apparatus described in U.S. Pat. Nos. 3,208,833, 3,214,247 and 3,523,762. These distributor-collectors serve to aid in the establishment and maintenance of vertical plug flow of the liquids along the length of the adsorbent bed. The two points at which any one stream enters and the corresponding effluent stream leaves the bed of adsorbent are separated from each other by at least two or more potential feed or withdrawal points which are not being used. For instance, the feed stream may enter the adsorption zone at one point and flow past nine potential withdrawal points and through nine distributor-collectors before reaching the point at which it is withdrawn from the adsorbent bed as the raffinate stream.

A switching of the process flow streams to these different locations is achieved through the use of a flow or fluid distribution means, which may be either a multiple-valve manifold or a single multiple port rotary disc valve. The use of the rotary valve is preferred. A central digital controller is preferably used to regulate the operation of the valve or manifold. This valve or manifold is connected to each inlet and outlet process line and also to a separate conduit connected to each of the potential inlet or outlet points along the length of the adsorbent bed. A much larger number of conduits is therefore normally employed than is shown in the Drawing, which has been simplified by the deletion of many unused conduits. Another difference between actual operation and the depiction in the Drawing is that the rotary valve is normally mounted in a horizontal plane rather than vertically as shown in the Drawing. Further details on the operation of a simulated moving bed of adsorbent and the preferred rotary valve may be obtained from the previously cited references and from U.S. Pat. Nos. 3,040,777; 3,192,954; 3,268,604; 3,268,605 and 3,422,848.

The subject invention comprises operating the required apparatus in such a manner that the viscous high solids content feed stream flows downward from the flow distribution means to the adsorbent bed through all the required conduits. That is, the flow distribution means is located at such an elevation that all of the conduits extend either horizontally or vertically downward running from the flow distribution means to the adsorbent bed. This is in contrast to the prior art arrangements in which, with a vertical adsorbent bed, about half of the conduits would extend upward from the flow distribution means to points located at higher elevations before entering the adsorbent bed. The subject invention provides an improved process in that the high solids content feed materials are easily flushed from descending transfer conduits with a minimum quantity of flush material and a reduced amount of backmixing. This improves the composition of the extract stream removed from the adsorbent bed and/or reduces the amount of the flush material which must be removed from the extract stream.

One embodiment of the process may be characterized as a process for separating monosaccharides which comprises the steps of passing a high solids content high viscosity feed stream, which comprises a mixture of at least two different monosaccharides, and a desorbent stream into a fluid distribution means located at a first elevation; passing the feed stream into a vertical fixed bed of solid adsorbent which selectively adsorbs at least one component of the feed stream at a first point, with the bed of solid adsorbent having an upper first end which is at a second elevation which is not above said first elevation; passing the desorbent stream into the bed of adsorbent at a third elevation; withdrawing a raffinate stream and an extract stream from the bed of adsorbent at a fourth and fifth elevation respectively; and periodically advancing the locations in the bed of adsorbent of the second, third, fourth and fifth elevations in a unidirectional pattern to simulate the utilization of a moving bed of adsorbent. In this embodiment the second to fifth elevations are all below the fluid distribution means at all times. The elevation or height of the fluid distribution means is to be determined by reference to the lowest outlet of the flow or fluid distribution means. In commercial applications this device is to be at essentially the same level as the top of the vessel containing the adsorbent bed, with the adsorbent bed being below the top of the vessel.

The subject process can be practiced using any type of commercially operable and practical selective adsorbent. The adsorbent could therefore be formed from granules which comprise resins, alumina, silica, various clays or carbon-based materials such as charcoal. The preferred adsorbent comprises a shape selective zeolite commonly referred to as a molecular sieve. The term "shape selective" refers to the zeolite's ability to separate molecules according to size or shape because of the fixed and relatively uniform cross sectional diameter of the zeolite's pore structure. The preferred zeolites comprise synthetic crystalline aluminosilicates. Since the pure zeolites are relatively soft and powdery, the commercially used molecular sieves comprise a binder such as clay or alumina to produce a stronger and more attrition-resistant adsorbent particle. The adsorbent particles preferably have a size range of about 10 to about 100 mesh (standard U.S. mesh).

The particular adsorbent utilized in the process will be chosen on the basis of the materials which it is desired to separate. Suitable adsorbents may often be determined by an examination of the available references including those patents cited herein. For the high solids content feed streams which are the preferred feedstock to the subject apparatus, and especially for feed means containing saccharides it is preferred that the adsorbent comprises a type Y or type X zeolite, with type X zeolites being preferred over type Y zeolites. These zeolitic materials must normally be exchanged with a cation at their exchangeable sites to be effective adsorbents and the particular cations chosen has a very important role in both the adsorptive capacity and selectivity of any particular adsorbent. For the separation of monosaccharides, such as the separation of a ketose from a mixture comprising a ketose and an aldose, it is preferred to utilize a type X zeolite containing a Group II-A cation. The separation of fructose from the feed stream by its selective adsorption is an example of this separation. Barium or strontium exchanged type X zeolites are suitable for this application. The zeolitic adsorbent may also be exchanged with a combination of cations. In this case the preferred cations are chosen from the group consisting of both barium and potassium and barium and strontium. Further information on suitable adsorbents for separations of this nature may be obtained by reference to U.S. Pat. Nos. 4,226,639 and 4,226,977.

Although adsorptive separation processes can be operated with both vapor phase and liquid phase conditions, the high solids content feed streams of the subject process dictate the use of liquid phase conditions. Adsorption-promoting conditions therefore include a pressure sufficient to maintain all of the chemical compounds present in the adsorbent bed as liquids. A pressure of from atmospheric to about 50 atmospheres may be employed with the pressure preferably being between 1.0 and 32 atmospheres gauge. Suitable operating temperatures range from about 40° to about 250° C., with the preferred operating temperatures being between 50° and 100° C.

As used herein, the term "feed stream" is intended to indicate a stream in the process which comprises the feed material and which is charged to the bed of adsorbent for the purpose of recovering the extract component from this stream. The feed stream will comprise one or more extract components and one or more raffinate components. An "extract component" is a chemical compound which is preferentially adsorbed by the adsorbent which is being utilized in the process as compared to a "raffinate component". Normally, although not exclusively, the term "extract component" is synonymous with the desired product of the process. For instance, in the separation of fructose from a mixture of fructose and glucose, fructose is an extract component and glucose is a raffinate component. The term "extract stream" refers to a stream which contains extract components originally present in the feed stream and which have been desorbed from the bed of adsorbent by the desorbent stream. The composition of the extract stream as it leaves the bed of adsorbent will normally vary with time and can range from about 100 mole percent extract components to about 100 mole percent desorbent components. The term "raffinate stream" is intended to indicate a stream which contains the majority of the unadsorbed raffinate components of the feed stream. This stream will normally also contain desorbent components which were picked up during passage through the adsorption zone, and the composition of the raffinate stream will also vary with time. The term "desorbent" is intended to indicate a chemical compound capable of desorbing the extract component from the bed of adsorbent. A "desorbent stream" is a process stream in which the desorbent is carried into the bed of adsorbent. A multi-component desorbent stream may be utilized. A wash stream may also be utilized in the process. As used herein, the term "wash stream" is intended to refer to a stream passed into the bed of adsorbent for the purpose of removing substantial amounts of the raffinate component of the feed stream from the interstitial void volume and nonselective pore volume of the adsorbent bed. The wash stream will contain a "wash component" which is sometimes referred to as a sweeping agent. The wash stream is intended to act upon the contents of adsorbent bed. It may therefore be considered a "zone flush" stream in comparison to previously described "line flush" streams which are intended to act upon the contents of the conduits extending between the adsorbent bed and the fluid distribution means.

I claim as my invention:

1. In a process for the separation of monosaccharides wherein a feed stream containing a mixture of monosaccharides and a desorbent stream are separately passed into a fixed bed of solid adsorbent at various points through a plurality of conduits which are attached to a flow distribution means to simulate a moving bed of adsorbent, the improvement which comprises locating the fluid distribution means at an elevation which is above the uppermost point at which one of the conduits communicates with the bed of adsorbent.

2. In a process for the separation of fructose and glucose wherein an aqueous feed stream comprising a mixture of fructose and glucose is passed into a fixed vertical bed of a solid adsorbent, which selectively adsorbs either fructose or glucose, at one of a number of various different points through a plurality of conduits which are attached to a fluid distribution means, and the point at which the feed stream enters the bed of adsorbent is periodically advanced to simulate the use of a moving bed of adsorbent, the improvement which comprises locating the fluid distribution means above the uppermost point at which the feed stream enters the bed of adsorbent.

3. A process for separating monosaccharides which comprises the steps of:

(a) passing a high viscosity feed stream, which comprises a mixture of at least two different monosaccharides, and a desorbent stream into a fluid distribution means located at a first elevation;

(b) passing the feed stream into a vertical fixed bed of solid adsorbent which selectively adsorbs at least one component of the feed stream at a first point, with the bed of solid adsorbent having an upper first end which is at a second elevation which is not above said first elevation;

(c) passing the desorbent stream into the bed of adsorbent at a third elevation;

(d) withdrawing a raffinate stream and an extract stream from the bed of adsorbent at a fourth and fifth elevations respectively; and, (e) periodically advancing the locations in the bed of adsorbent of the second, third, fourth and fifth elevations in a unidirectional pattern to simulate the utilization of a moving bed of adsorbent.

4. The process of claim 3 further characterized in that a rotary valve type fluid distribution means is employed.

5. The process of claim 4 further characterized in that a ketose is selectively adsorbed by the solid adsorbent.

6. The process of claim 5 further characterized in that the ketose is fructose.

7. The process of claim 3 further characterized in that the feed stream has a specific gravity 10 percent greater than the desorbent stream and also has a viscosity 50 percent greater than the desorbent stream.

8. A process for the adsorptive separation of a mixture of monosaccharide compounds which comprises the steps of:

(a) passing a multi-component feed stream which comprises 35 wt.% solids on a dry basis through a rotary valve type flow distribution means and into a fixed vertical bed of a solid adsorbent which selectively adsorbs one monosaccharide from the feed stream containing said mixture of monosaccharides at a first point in the bed of adsorbent;

(b) passing a desorbent stream through the flow distribution means and into the bed of adsorbent at a second point;

(c) withdrawing a raffinate stream from the bed of adsorbent at a third point;

(d) withdrawing a extract stream from the bed of adsorbent at a fourth point; and, (e) periodically advancing the locations of the first, second, third and fourth points in the bed of adsorbent in a unidirectional pattern, with the first, second, third and fourth points being at an elevation which is below that of the fluid distribution means.

9. The process of claim 8 further characterized in that the feed stream and the desorbent stream comprise water.

10. The process of claim 8 further characterized in that one of said monosaccharide compounds in the feed stream comprises fructose.

11. The process of claim 10 further characterized in that one of said monosaccharide compounds in the feed stream comprises glucose.

12. The process of claim 8 further characterized in that the feed stream comprises 45 wt.% solids on a dry basis.

13. The process of claim 8 further characterized in that the feed stream has a specific gravity 10 percent greater than the desorbent stream and also has a viscosity 50 percent greater than the desorbent stream.

* * * * *